US011575223B2

(12) United States Patent
Hosoda

(10) Patent No.: US 11,575,223 B2
(45) Date of Patent: Feb. 7, 2023

(54) CONNECTOR AND CONNECTOR APPARATUS

(71) Applicant: HIROSE ELECTRIC CO., LTD., Kanagawa (JP)

(72) Inventor: Shohei Hosoda, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/385,280

(22) Filed: Jul. 26, 2021

(65) Prior Publication Data

US 2022/0037819 A1 Feb. 3, 2022

(30) Foreign Application Priority Data

Aug. 3, 2020 (JP) ..... JP2020-131426

(51) Int. Cl.

| | |
|---|---|
| ***H01R 12/71*** | (2011.01) |
| ***H01R 13/629*** | (2006.01) |
| ***H01R 13/502*** | (2006.01) |
| ***H01R 12/70*** | (2011.01) |
| ***H01R 13/639*** | (2006.01) |

(52) U.S. Cl.

CPC ..... *H01R 12/716* (2013.01); *H01R 12/7005* (2013.01); *H01R 13/502* (2013.01); *H01R 13/629* (2013.01); *H01R 13/639* (2013.01)

(58) Field of Classification Search

CPC ..... H01R 12/716; H01R 12/7005; H01R 13/502; H01R 13/629; H01R 13/639; H01R 13/6582; H01R 12/73; H01R 13/20; H01R 12/71

See application file for complete search history.

(56) References Cited

U.S. PATENT DOCUMENTS

| | | | | |
|---|---|---|---|---|
| 7,059,908 | B2 * | 6/2006 | Yamaguchi | H01R 13/6583 439/607.17 |
| 9,484,648 | B2 * | 11/2016 | Takenaga | H01R 13/405 |
| 9,543,675 | B1 * | 1/2017 | Takenaga | H01R 13/635 |
| 10,784,616 | B2 * | 9/2020 | Gondo | H01R 12/716 |
| 2013/0137308 | A1 * | 5/2013 | Chiang | H01R 12/716 439/660 |
| 2017/0005423 | A1 * | 1/2017 | Takenaga | H01R 13/635 |

(Continued)

FOREIGN PATENT DOCUMENTS

JP 2020-31025 A 2/2020

*Primary Examiner* — Peter G Leigh
*Assistant Examiner* — Nelson R. Burgos-Guntin
(74) *Attorney, Agent, or Firm* — Rankin, Hill & Clark LLP

(57) ABSTRACT

Provided is a connector which includes: a plurality of terminals; additional members configured to maintain a state of being mated with a counterpart connector; and a housing, in which the additional members each include a first lock portion and second lock portions, the housing includes first side wall portions each holding the first lock portion, and second side wall portions each holding the second lock portions, the first lock portion includes a curved surface protruding relative to a front surface of the first side wall portion, the second lock portion includes a curved surface protruding relative to a front surface of the second side wall portion, the first lock portion is divided in a direction orthogonal to the first side wall portion, and the second lock portion extends in a direction orthogonal to the first lock portion, on each side of the first lock portion.

8 Claims, 10 Drawing Sheets

(56) References Cited

U.S. PATENT DOCUMENTS

| | | | | |
|---|---|---|---|---|
| 2020/0067217 | A1 | 2/2020 | Ashibu | |
| 2020/0295484 | A1* | 9/2020 | Kobayashi | H01R 12/716 |
| 2022/0263275 | A1* | 8/2022 | Oosaka | H01R 12/716 |

* cited by examiner

CONNECTOR AND CONNECTOR APPARATUS

CROSS-REFERENCE TO RELATED APPLICATION

This application claims priority from Japanese Patent Application No. 2020-131426 filed with the Japan Patent Office on Aug. 3, 2020, the entire content of which is hereby incorporated by reference.

BACKGROUND

1. Technical Field

The present disclosure relates to a connector and a connector apparatus.

2. Related Art

A connector structure that is easy to mate a plug connector and a receptacle connector when the connectors are mated together for connection and includes a lock portion for making it difficult for the connectors to be detached from each other is being desired. Specifically, a structure of a metal member that facilitates mating and unmating of a board connection connector for connecting boards such as printed wiring boards or flexible flat cables, the board connection connector including a housing where a plurality of terminals is held, is being desired for the board connection connector.

Examples of the board connection connector for connecting boards, in which a plurality of terminals is arranged and held by, for example, insert molding (integral molding) in a housing include a connector disclosed in JP-A-2020-031025. The connector includes a plug-side connector (a plug connector), a receptacle-side connector (a receptacle connector) that is connected to the plug-side connector, and a rectangular housing where a plurality of terminals is arranged and held in the longitudinal direction.

Each of the plug connector and the receptacle connector can be provided to, for example, a printed wiring board or flexible flat cable. For example, a receptacle connector provided on a printed wiring board by, for example, surface mounting and a plug connector provided at an end of a flexible flat cable are mated together, which can establish connection between the boards.

In order to maintain a state where the connectors are connected together, the connectors have structures that fit into each other. For example, in JP-A-2020-031025 mentioned above, the plug connector and the receptacle connector include a metal member on each side in the longitudinal direction across lines of the plurality of terminals, in addition to the plurality of terminals. A part, which faces inward, of the metal member of the receptacle connector is provided with a protruding additional member. A part, which faces outward, of the metal member of the plug connector is provided with a recessed portion. When the connectors are mated together, the protruding additional member fits into the recessed portion. Accordingly, it is possible to maintain a state where the metal member of the plug connector and the metal member of the receptacle connector are electrically connected.

SUMMARY

A connector according to the present embodiment is configured to include: a plurality of terminals; additional members configured to maintain a state of being mated with a counterpart connector; and a housing, in which the additional members each include a first lock portion and second lock portions, the housing includes first side wall portions each holding the first lock portion, and second side wall portions each holding the second lock portions, the first lock portion includes a curved surface protruding relative to a front surface of the first side wall portion, the second lock portion includes a curved surface protruding relative to a front surface of the second side wall portion, the first lock portion is divided in a direction orthogonal to the first side wall portion, and the second lock portion extends in a direction orthogonal to the first lock portion, on each side of the first lock portion.

DETAILED DESCRIPTION

Figure 1:
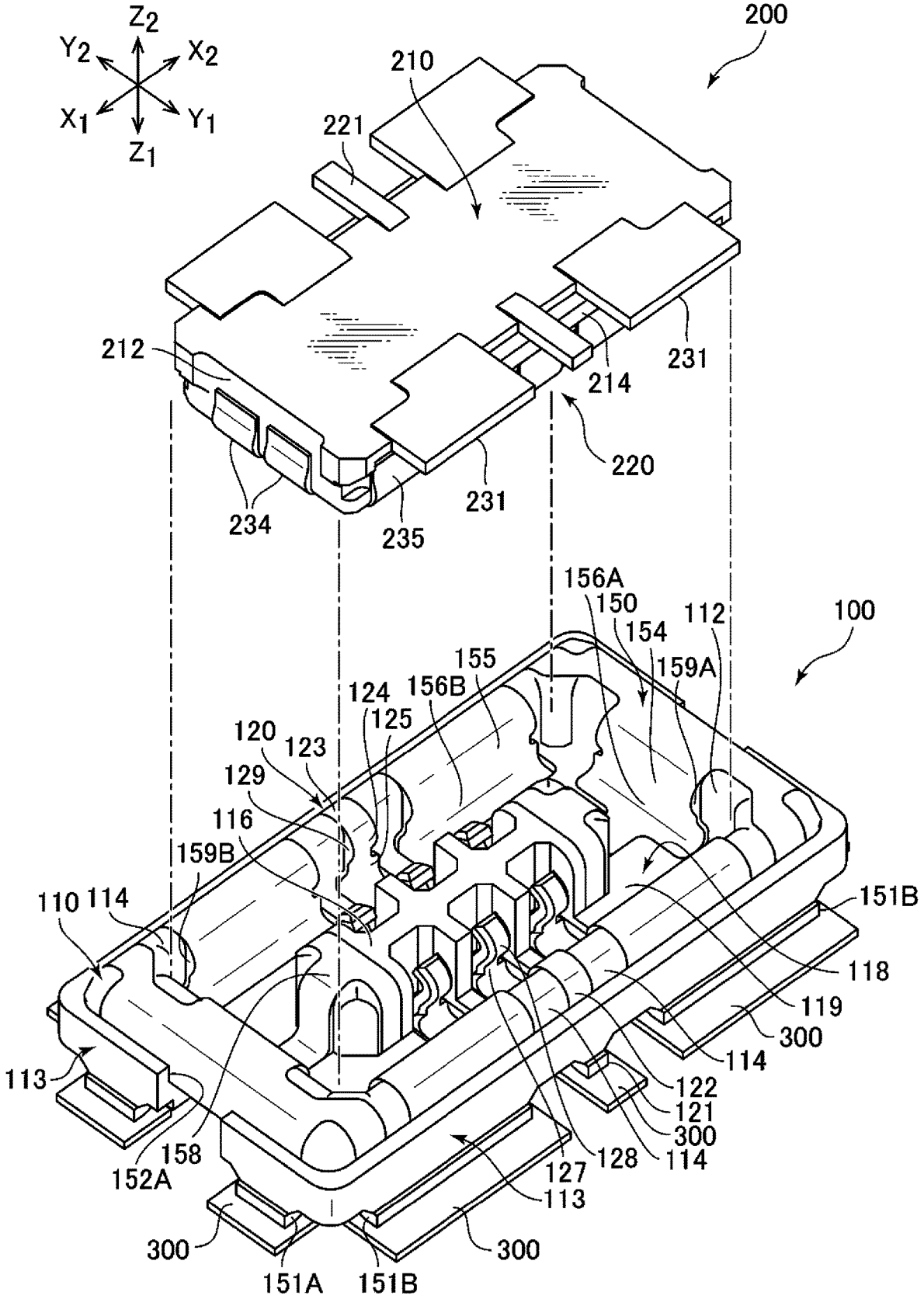
FIG. 1 is a perspective view of a plug connector and a receptacle connector according to an embodiment of the present disclosure as viewed from the plug connector side.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, in terms of the plug and receptacle connectors described in JP-A-2020-031025, the protruding portion (additional member) and the recessed portion of the metal members of the connectors fit into each other to maintain the state where the connectors are connected to each other. As a result, the force applied upon mating and unmating of the connectors concentrates on the protruding and recessed portions of the metal members. Hence, the force to maintain the state where the protruding and recessed portions of the metal members of the connectors fit in each other may become weak due to deformation or wearing out of the protruding and recessed portions of the metal members.

Moreover, the plug and receptacle connectors that connect boards are each mounted on a board in a small electronic device such as a smartphone or mobile terminal. Hence, the plug connector and the receptacle connector are very small connectors. The plurality of terminals and the metal members, which are components of the plug and receptacle connectors, are also very small. Hence, working the metal members without an error, and providing the protruding portion (additional member) to the metal member of one of the connectors and the recessed portion to the metal member of the other connector can be a step that increases the manufacturing cost.

In order to solve a problem such as described above, a plug connector and a receptacle connector of the present disclosure are connectors including: a plurality of terminals; additional members configured to maintain a state of being mated with a counterpart connector; and a housing, and are configured in such a manner that the additional members each include a first lock portion and second lock portions, the housing includes first side wall portions each holding the first lock portion, and second side wall portions each holding the second lock portions, and the first and second lock portions include curved surfaces protruding relative to front surfaces of the first and second side wall portions, respectively. Such a configuration allows omitting the step of working the metal members and providing a protruding portion and a recessed portion from the manufacturing process. Accordingly, the manufacturing cost can be reduced. Furthermore, it is possible to prevent the force applied upon mating and unmating of the connectors from concentrating on a single spot. Accordingly, it is possible to provide a connector including lock portions resistant to deformation and wear.

A connector according to the present disclosure includes: a plurality of terminals; additional members configured to maintain a state of being mated with a counterpart connector; and a housing, in which the additional members each include a first lock portion and second lock portions, the housing includes first side wall portions each holding the first lock portion, and second side wall portions each holding the second lock portions, the first lock portion includes a curved surface protruding relative to a front surface of the first side wall portion, the second lock portion includes a curved surface protruding relative to a front surface of the second side wall portion, the first lock portion is divided in a direction orthogonal to the first side wall portion, and the second lock portion extends in a direction orthogonal to the first lock portion, on each side of the first lock portion.

The plug connector and the receptacle connector of the present disclosure are configured in such a manner that the lock portion provided to the housing includes the curved surface protruding relative to the front surface of the side wall portion. Accordingly, when being connected to the counterpart connector, the connector makes not point-to-point but surface-to-surface engagement with a counterpart lock portion of the counterpart connector. Consequently, not only can the state where the connectors are mated with each other be maintained, but the force applied upon the mating and unmating of the connectors can be dispersed. Accordingly, the deformation and wearing out of the lock portions can be prevented.

Moreover, the lock portions of the plug connector and the receptacle connector of the present disclosure are configured in such a manner as to protrude from the front surface of the side wall portion. Accordingly, there is no need to work the front surfaces of the additional members (metal members) to form the protruding portion and the recessed portion. Hence, the manufacturing cost can be reduced.

Furthermore, the plug connector and the receptacle connector of the present disclosure each include the first lock portion and the second lock portions, which engage with a first counterpart lock portion and second counterpart lock portions of the counterpart connector. Hence, it is possible to sufficiently maintain the state where the connectors are mated together. Furthermore, the first lock portion of one of the connectors is divided into two. Accordingly, it is possible to facilitate deformation of the first side wall portion holding the first lock portion divided into two, together with the first lock portion, when the connectors are mated together. Hence, the force applied to the first lock portion is released due to the deformation of the first lock portion divided into two and the first side wall portion holding the first lock portion; accordingly, the force applied upon the mating of the connectors can be adjusted.

Embodiments of the present disclosure are described hereinafter with reference to the drawings. The same reference numerals are assigned to the same members in principle in all the figures for describing the embodiments. Repeated descriptions thereof are omitted. Moreover, the configuration and shape of the plug connector or receptacle connector according to the embodiments of the present disclosure have a relationship of symmetry about a point with a central axis in a mating direction (Z-axis direction) as a point of symmetry. Hence, the assignment of the same reference numerals to portions, members, components, and the like that are point-symmetric to portions, members, components, and the like to which reference numerals are assigned is basically omitted. Furthermore, each embodiment is described independently; however, the configuration of the plug connector or receptacle connector where their respective constituent elements are combined is not avoided. Moreover, a configuration including the plug and receptacle connectors may be referred to as a connector apparatus in the following description.

In the description and the claims, two connectors are referred to as a plug connector and a receptacle connector to be distinguished. Members, components, and the like of the plug connector and the receptacle connector are referred to as a plug housing and a receptacle housing, a plug terminal and a receptacle terminal, a first plug lock portion and a first receptacle lock portion, a second plug lock portion and a second receptacle lock portion, a plug flat portion and a receptacle flat portion, and the like. However, if the connectors are not distinguished by shape, the plug housing and the receptacle housing, the plug terminal and the receptacle terminal, the first plug lock portion and the first receptacle lock portion, the second plug lock portion and the second receptacle lock portion, the plug flat portion and the receptacle flat portion, and the like may be simply referred to as connectors, housings, terminals, first lock portions, second lock portions, and flat portions, omitting the expressions, plug and receptacle, therefrom.

Moreover, if the connectors are not distinguished by shape, one of the connectors that mates with the other connector is called a counterpart connector, and the first and second lock portions of the counterpart connector are referred to as a first counterpart lock portion and a second counterpart lock portion.

Figure 2:
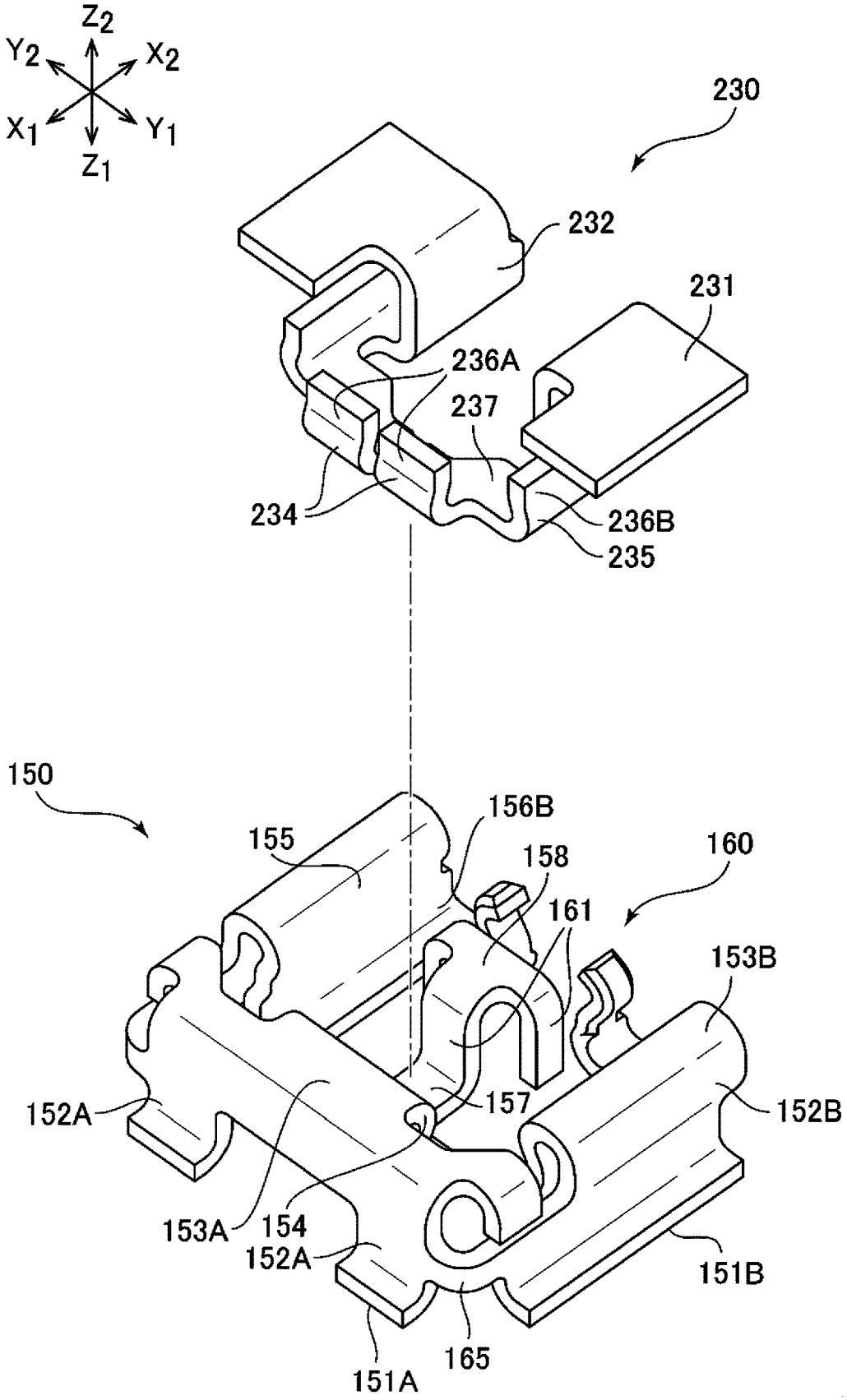
FIG. 2 is a perspective view of a plug additional member and a receptacle additional member, which are included respectively in the plug and receptacle connectors illustrated in FIG. 1.
Figure 3:
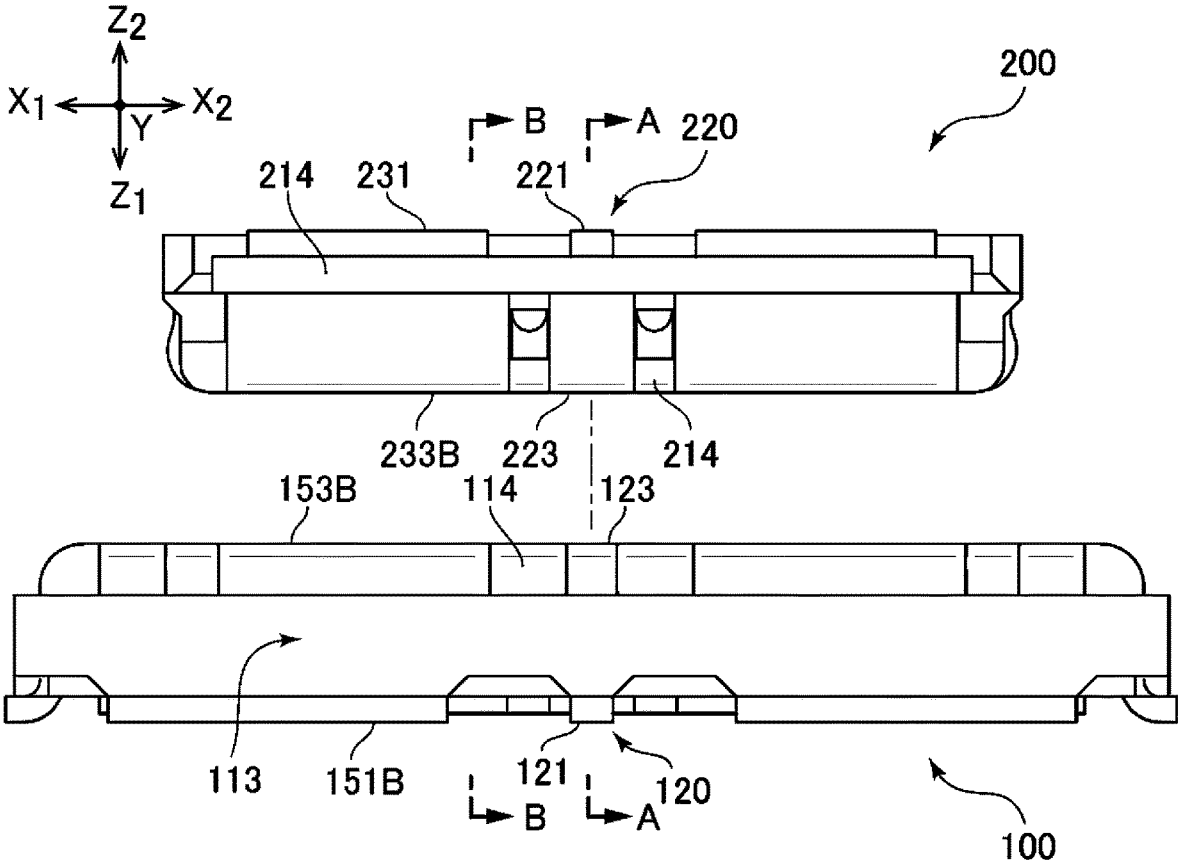
FIG. 3 is a side view of the plug connector and the receptacle connector according to the embodiment of the present disclosure.
Figure 4:
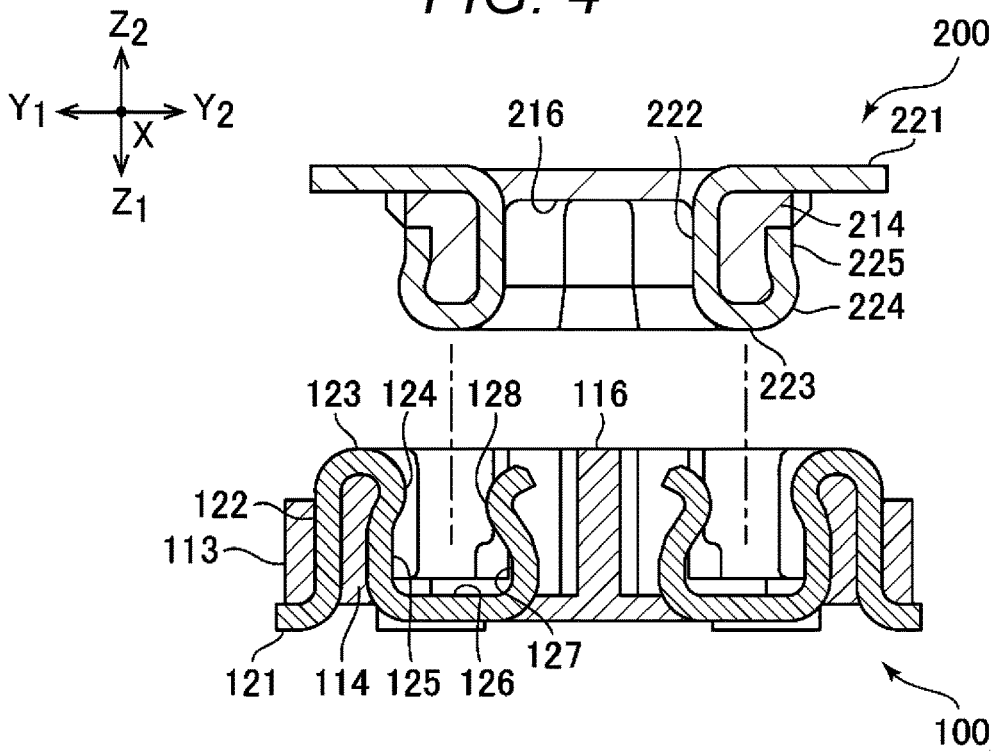
FIG. 4 is a cross-sectional view of a plug terminal and a receptacle terminal cut along a cut section A-A illustrated in FIG. 3.
Figure 5:
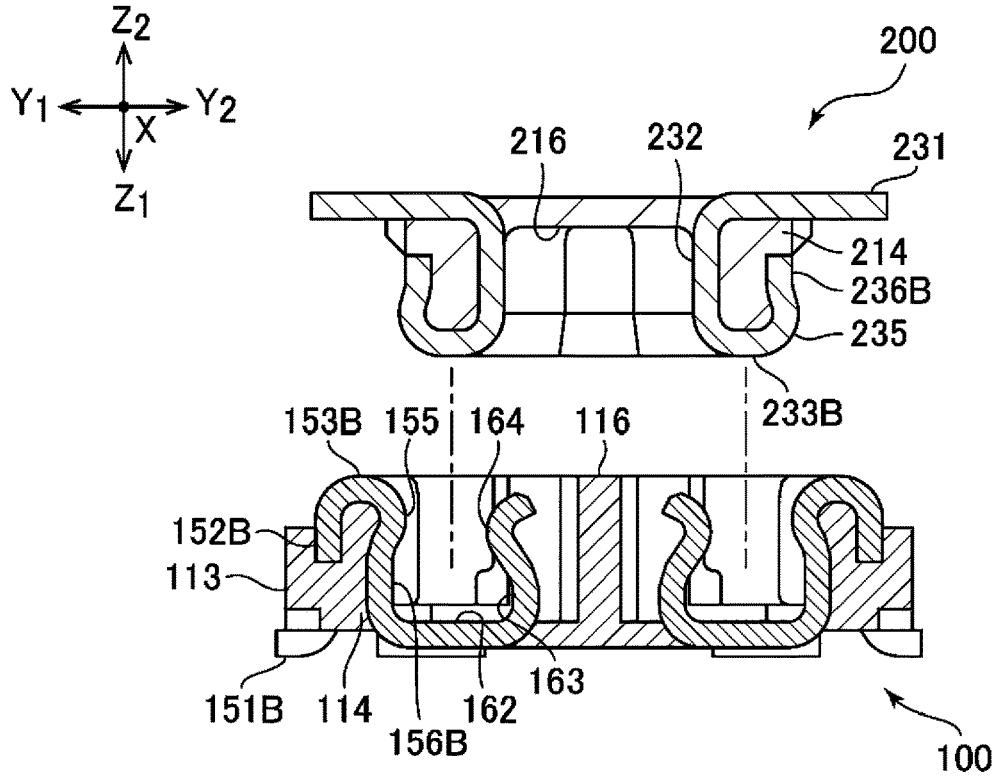
FIG. 5 is a cross-sectional view of a power supply terminal and a portion where the power supply terminal contacts, cut along a cut section B-B illustrated in FIG. 3.
Figure 6:
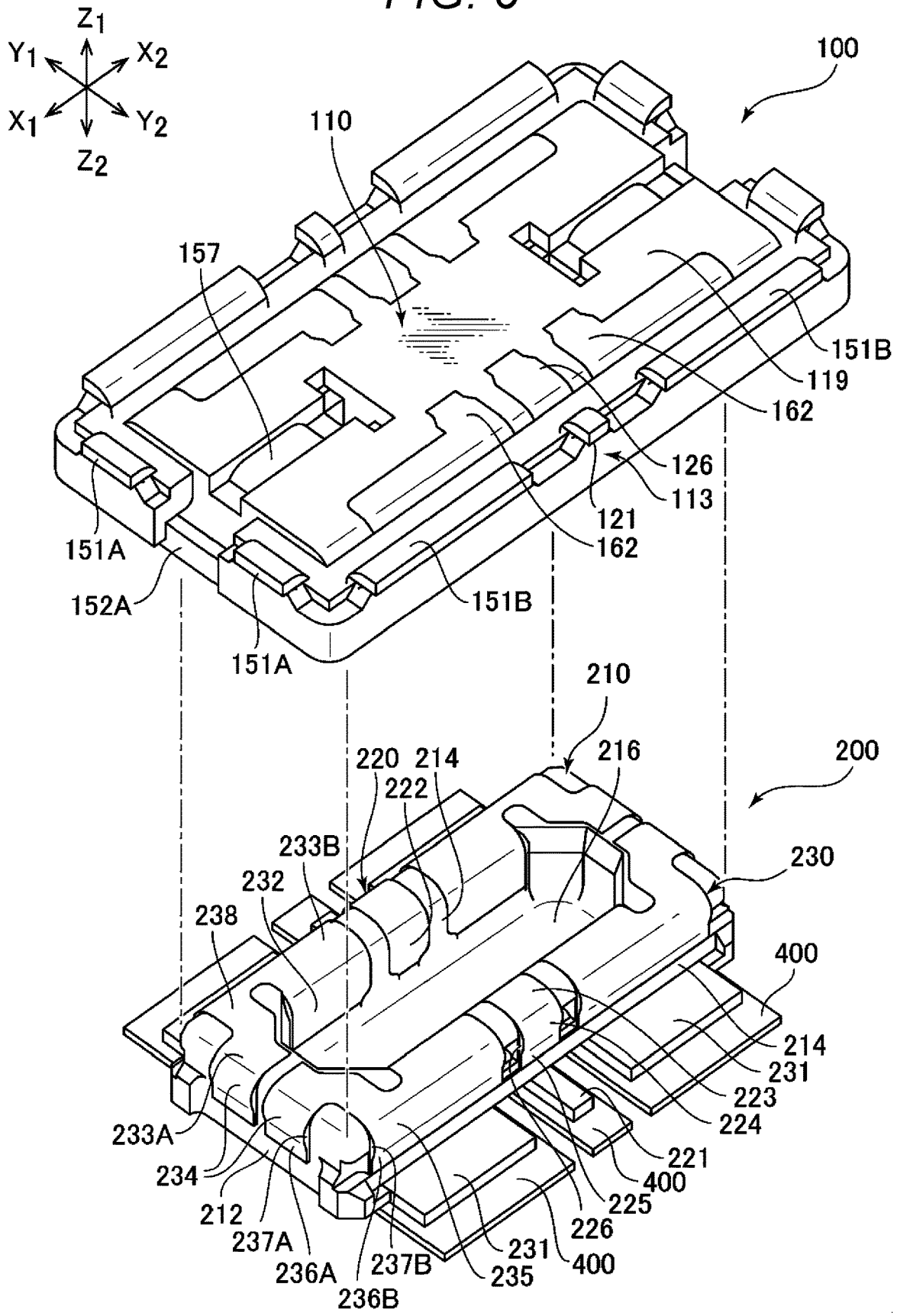
FIG. 6 is a perspective view of the plug connector and the receptacle connector according to the embodiment of the present disclosure as viewed from the receptacle connector side.
Figure 7:
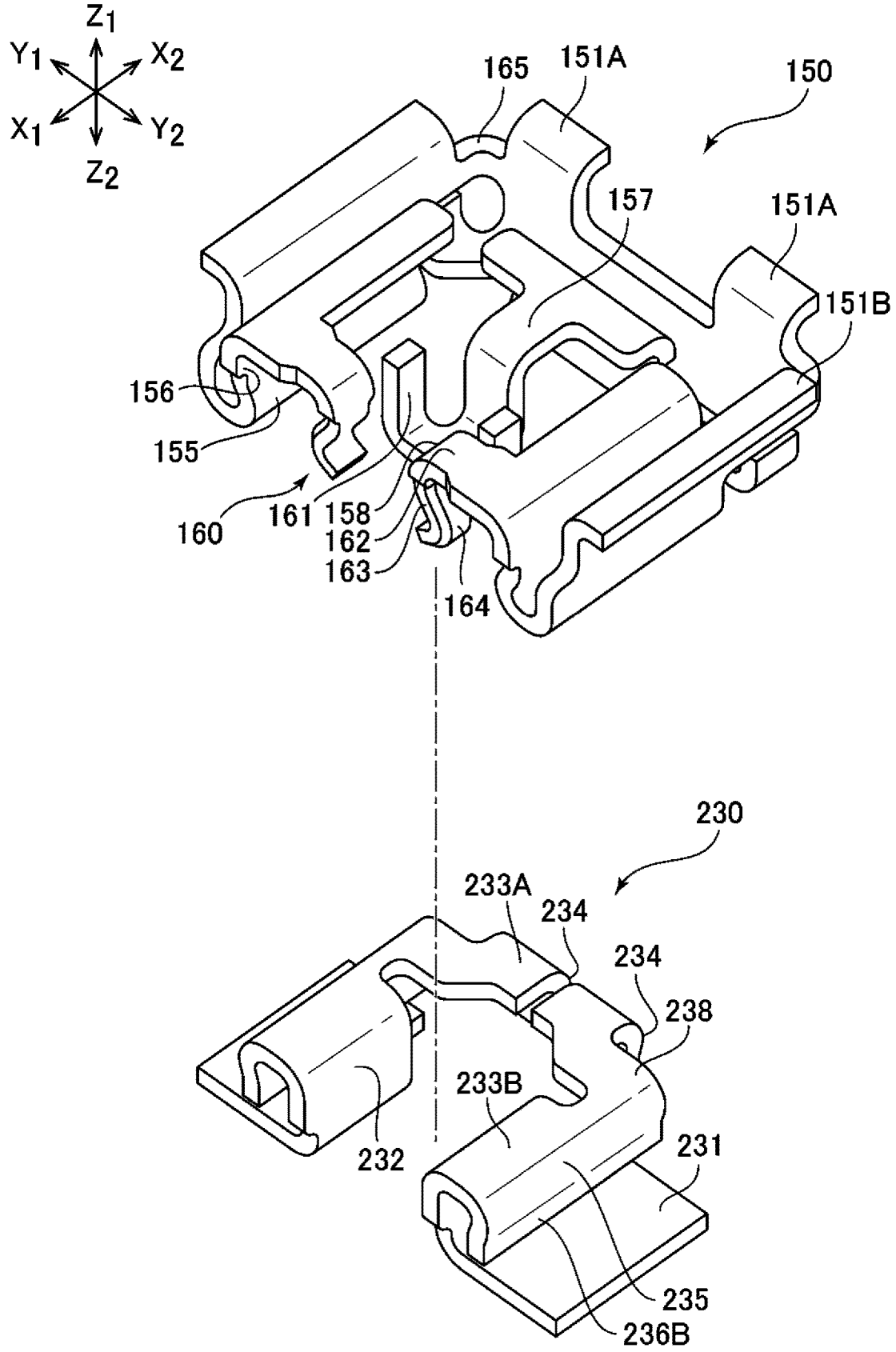
FIG. 7 is a perspective view of the plug additional member and the receptacle additional member, which are included respectively in the plug and receptacle connectors illustrated in FIG. 6.

FIGS. 1 to 7 illustrate the plug connector and the receptacle connector according to an embodiment of the present disclosure. FIG. 1 is a perspective view of the external appearances of the plug connector and the receptacle connector according to the embodiment of the present disclosure as viewed from the plug connector side (Z2 side). FIG. 2 is a perspective view of a plug additional member and a receptacle additional member, which are included respectively in the plug and receptacle connectors illustrated in FIG. 1. FIG. 3 is a side view of the plug connector and the receptacle connector according to the embodiment of the present disclosure as viewed from a side surface (Y1 side). FIG. 4 is a cross-sectional view of a plug terminal and a receptacle terminal cut along a cut section A-A illustrated in FIG. 3. FIG. 5 is a cross-sectional view of a power supply terminal and a portion where the power supply terminal contacts, cut along a cut section B-B illustrated in FIG. 3. FIG. 6 is a diagram obtained by turning FIG. 1 upside down, and is a perspective view of the external appearances of the plug connector and the receptacle connector as viewed from the receptacle connector side (Z1 side). FIG. 7 is a perspective view of the plug additional member and the receptacle additional member, which are included respectively in the plug and receptacle connectors illustrated in FIG. 6.

The plug and receptacle connectors of the present disclosure can be used as internal components in a small electronic device such as a mobile phone, smartphone, digital camera, or notebook. The mating direction of the connector is a Z1-Z2 direction (Z-axis direction) in the figures. A plug connector 200 mates with a receptacle connector 100 being a counterpart connector on the Z1 side in the Z-axis direction. The receptacle connector 100 mates with the plug connector 200 being a counterpart connector on the Z2 side in the Z-axis direction. Accordingly, they are electrically connected. In the present disclosure, a longitudinal direction of the rectangular connector is an X1-X2 direction (X-axis direction), and a transverse direction orthogonal to the longitudinal direction (X-axis direction) is a Y1-Y2 direction (Y-axis direction).

Moreover, in terms of up and down in the receptacle connector 100 and a receptacle terminal 120, a board side (a side that is mounted on a board) is "down" or "back", and a side that receives the plug connector 200 and a plug terminal 220 is "up" or "front". Similarly, also in terms of up and down in the plug connector 200 and the plug terminal 220, a board side (a side that is mounted on a board) is "down" or "back", and a side that receives the receptacle connector 100 and the receptacle terminal 120 is "up" or "front".

The receptacle connector 100 and the plug connector 200 are mounted by being soldered onto, for example, a printed wiring board or flexible flat cable. A printed wiring board, a flexible flat cable, or the like where the connector is mounted is simply called a "board". As illustrated in FIG. 1, the receptacle connector 100 is mounted on a board 300. As illustrated in FIG. 6, the plug connector 200 is mounted on a board 400.

Firstly, the configuration of the receptacle connector 100 is described with reference mainly to FIGS. 1 and 2. The receptacle connector 100 includes a receptacle housing 110, the receptacle terminal 120, and receptacle additional members 150 for maintaining a state of being mated with the plug connector 200 being the counterpart connector. The receptacle terminal 120 is made of metal such as phosphor bronze. The receptacle terminal 120 is buried in a second side wall portion 114 extending in the longitudinal direction (X-axis direction) of the receptacle housing 110 in a state where a front surface that contacts the plug terminal 220 being a counterpart terminal is exposed from the second side wall portion 114 and, accordingly, is held by the receptacle housing 110. The receptacle terminal 120 includes a mounting portion 121 to be mounted on the board 300 by, for example, soldering in an end thereof.

The receptacle housing 110 is made of insulating resin such as liquid crystal polymer (LCP). The receptacle housing 110 includes first side wall portions 112 extending in the transverse direction (Y-axis direction), and the second side wall portions 114 extending in the longitudinal direction (X-axis direction), and includes a mating protruding portion 116 extending in the longitudinal direction (X-axis direction) in a center part surrounded by the first side wall portions 112 and the second side wall portions 114. In other words, the receptacle housing 110 includes the mating protruding portion 116 on a movable portion 127 side of the receptacle terminal 120, and includes the second side wall portion 114 on a fixed portion 125 side of the receptacle terminal 120. Moreover, the receptacle housing 110 includes a receiving portion 118, as a space for housing first side wall portions 212 and second side wall portions 214 (refer to FIG. 6), between the mating protruding portion 116, and the first side wall portions 112 and the second side wall portions 114.

When the receptacle connector 100 and the plug connector 200 are connected to each other, the mating protruding portion 116 of the receptacle connector 100 is housed in a mating recessed portion 216 (refer to FIG. 6) of the plug connector 200. The first side wall portions 212 and the second side wall portions 214 (refer to FIG. 6) of the plug connector 200 are housed in the receiving portion 118 of the receptacle connector 100.

With reference to FIG. 4 in addition to FIGS. 1 and 2, the receptacle terminal 120 includes a leg portion 122 via a portion bent upward (toward Z2 in the Z-axis direction) from the mounting portion 121. The leg portion 122 faces a fixed contact 124 and the fixed portion 125 across the second side wall portion 114 of the receptacle housing 110. The leg portion 122 is connected to the fixed contact 124 and the fixed portion 125 via a top portion 123 located at an upper end of the second side wall portion 114.

The leg portion 122 is covered with the resin of the receptacle housing 110 (the resin of a peripheral wall portion 113 and the second side wall portion 114) all around except for a portion adjacent to the top portion 123. In other words, the leg portion 122 is buried in the second side wall portion 114 by the peripheral wall portion 113 that surrounds the first side wall portion 112 and the second side wall portion 114, except the portion adjacent to the top portion 123 and, accordingly, is held by the receptacle housing 110. A back surface of each of the leg portion 122, the top portion 123, the fixed contact 124, and the fixed portion 125 (each surface opposite to surfaces that contact the counterpart terminal) is supported by the second side wall portion 114. In other words, the opposing surface of each of the leg portion 122 and the fixed portion 125 of the receptacle terminal 120 is supported by the second side wall portion 114.

The fixed contact 124 of the receptacle terminal 120 protrudes toward the mating protruding portion 116 relative to a front surface of the second side wall portion 114. A contact side surface 129 of the fixed contact 124 is exposed from the second side wall portion 114. The fixed contact 124 is electrically connected to and in contact with an outer leg portion 225 in a state of being mated with the plug terminal 220 being the counterpart terminal (refer to FIG. 4). The surface, which is opposite to the surface that contacts the counterpart terminal, of each of the fixed contact 124 and the fixed portion 125 is supported and fixed by the second side wall portion 114 in such a manner as to be immovable upon mating with the counterpart terminal.

As is clear also from the cross-sectional view illustrated in FIG. 4, the receptacle terminal 120 is formed by insert molding (integral molding) with the receptacle housing 110, and is in intimate contact with the receptacle housing 110 except the portion on the movable portion 127 side. Moreover, a space surrounded by the leg portion 122, the top portion 123, the fixed contact 124, and the fixed portion 125 of the receptacle terminal 120 is filled with the resin (the housing).

The receptacle terminal 120 includes a bottom portion 126 connected to the fixed portion 125 and the movable portion 127, between the fixed portion 125 and the movable portion 127. The bottom portion 126 is connected to the fixed portion 125 and the movable portion 127 via a portion that extends in the transverse direction (Y-axis direction) of the receptacle connector 100 and is bent at a right angle. The thickness direction of the bottom portion 126 is along the mating direction (Z-axis direction). A surface of the bottom portion 126 on the receiving portion 118 side (a surface on the Z2 side) is exposed from a bottom wall 119 of the receptacle housing 110. A part of a surface on the board side (a surface opposite to the counterpart terminal receiving surface (the surface on the Z2 side) (a surface on the Z1 side)), that is, a back surface, of the bottom portion 126 is exposed from a back surface of the bottom wall 119 of the receptacle housing 110. A portion excluding the exposed portion is supported by the resin near the second side wall portion 114 and the mating protruding portion 116 (refer to FIG. 6). Hence, the movable portion 127 is not visible from the back surface side of the bottom wall 119.

The movable portion 127 is not in contact with a side wall of the mating protruding portion 116. An end of the movable portion 127 is a free end. The movable portion 127 includes a movable contact 128 that is formed by causing the periphery of the end to protrude toward the fixed contact 124. The movable portion 127 is pressed by elasticity toward the mating protruding portion 116 and deforms when receiving and mating with the plug terminal 220 being the counterpart terminal. The movable contact 128 comes into contact with an inner leg portion 222 of the plug terminal 220 in the mated state to be electrically connected to the inner leg portion 222.

The receptacle additional member 150 is placed on each side of the receptacle connector 100 across a center part of the second side wall portion 114 holding the receptacle terminal 120. In other words, the receptacle additional member 150 is provided at each end of the receptacle connector 100 in the longitudinal direction (X-axis direction). The receptacle additional member 150 includes one first receptacle lock portion 154 and a pair of second receptacle lock portions 155. The receptacle housing 110 holds the one first receptacle lock portion 154 on the first side wall portion 112, and holds the pair of second receptacle lock portions 155 on the second side wall portions 114. The receptacle additional member 150 includes the pair of second receptacle lock portions 155 extending in a direction orthogonal to the first receptacle lock portion 154 (the X-axis direction) respectively on both sides (the Y1 and Y2 sides) of the first receptacle lock portion 154 held by the first side wall portion 112. In other words, the first receptacle lock portion 154 is located in the transverse direction (Y-axis direction) between the pair of second receptacle lock portions 155. A portion including the first receptacle lock portion 154 and a portion including the second receptacle lock portion 155 are connected to each other via a receptacle coupling portion 165. The receptacle coupling portion 165 is buried in the receptacle housing 110.

Figure 8:
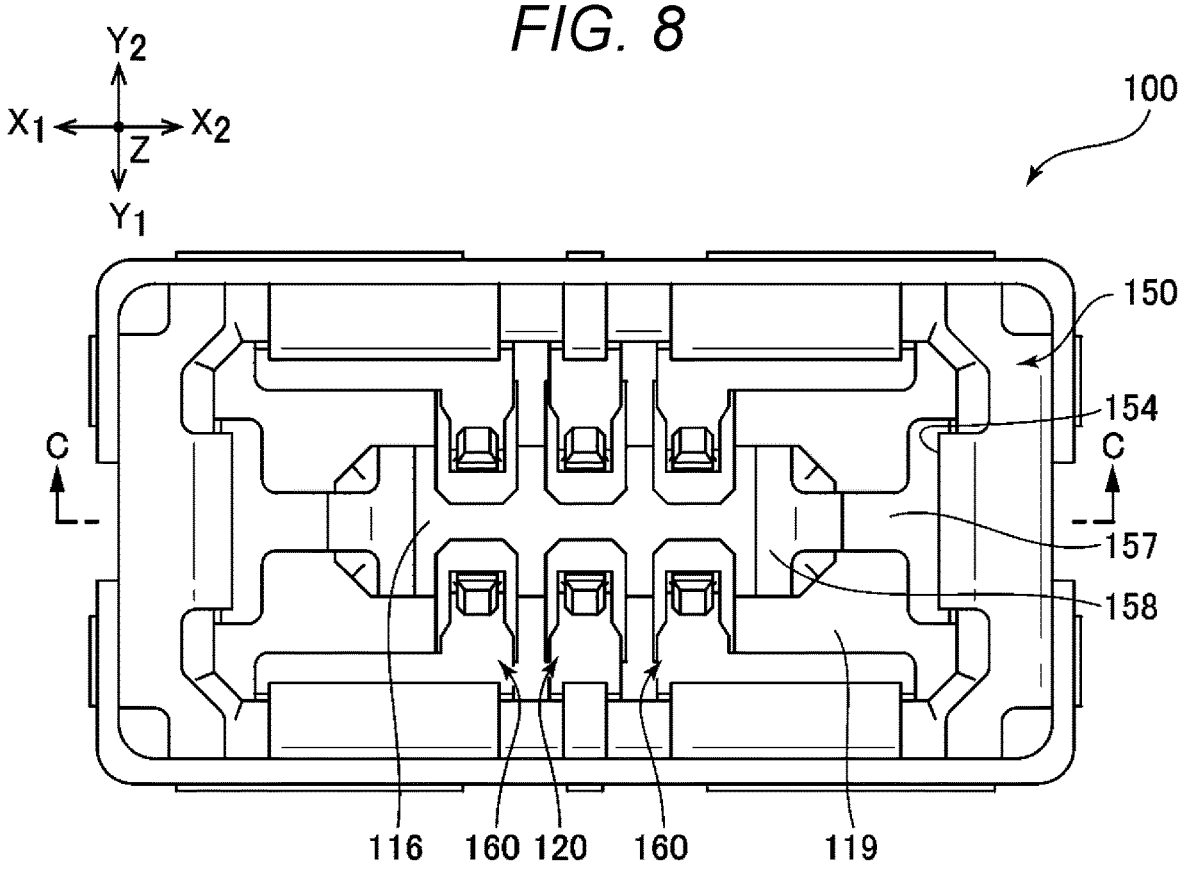
FIG. 8 is a top view of the receptacle connector according to the embodiment of the present disclosure.
Figure 9:
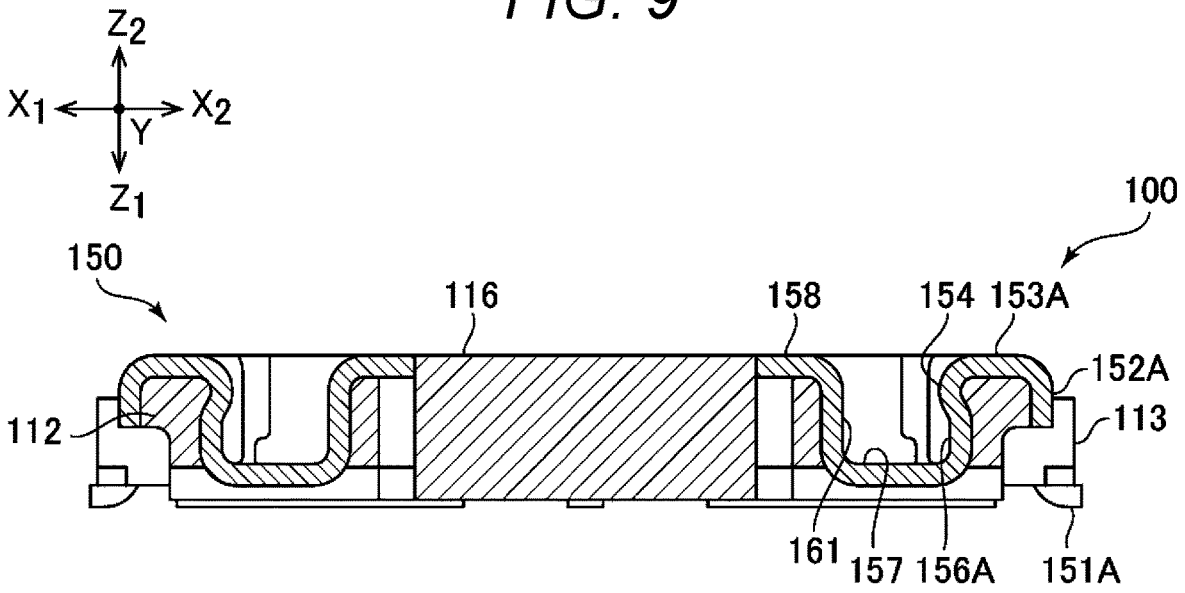
FIG. 9 is a cross-sectional view of the receptacle connector cut along a cut section C-C illustrated in FIG. 8.

Also with reference to FIGS. 8 and 9 in addition to FIGS. 1 and 2, the configuration of the receptacle connector according to the embodiment of the present disclosure is described. FIG. 8 is a top view of the receptacle connector according to the embodiment of the present disclosure. FIG. 9 is a cross-sectional view of the receptacle connector cut along a cut section C-C illustrated in FIG. 8.

The receptacle additional member 150 includes mounting portions 151A and 151B to be mounted on the board 300 by, for example, soldering. The receptacle additional member 150 includes receptacle leg portions 152A and 152B via portions bent upward (toward Z2 in the Z-axis direction) from the mounting portions 151A and 151B. The first receptacle lock portion 154 and the receptacle leg portion 152A face each other across the first side wall portion 112. The first receptacle lock portion 154 and the receptacle leg portion 152A are connected to each other via a top portion 153A located at an end of the first side wall portion 112. Similarly, the second receptacle lock portion 155 and the receptacle leg portion 152B face each other across the second side wall portion 114. The second receptacle lock portion 155 and the receptacle leg portion 152B are connected to each other via a top portion 153B located at an end of the second side wall portion 114.

The first receptacle lock portion 154 is connected to the mounting portion 151A via the receptacle leg portion 152A. The mounting portion 151A is mounted on the board 300 by, for example, soldering. Accordingly, the receptacle additional member 150 can endure the force that is applied when the connectors are connected to each other. Similarly, the second receptacle lock portion 155 is connected to the mounting portion 151B via the receptacle leg portion 152B. The mounting portion 151B is mounted on the board 300 by, for example, soldering. Accordingly, the receptacle additional member 150 can endure the force that is applied when the connectors are connected to each other.

The receptacle leg portions 152A and 152B are covered with the resin of the receptacle housing 110 all around except for portions adjacent to the top portions 153A and 153B. In other words, the receptacle leg portions 152A and 152B are buried in the first side wall portion 112 and the second side wall portion 114 by the peripheral wall portion 113 that surrounds the first side wall portion 112 and the second side wall portion 114, except the portions adjacent to the top portions 153A and 153B and, accordingly, are held by the receptacle housing 110. A back surface of each of the receptacle leg portion 152A, the top portion 153A, and the first receptacle lock portion 154 is supported by the first side wall portion 112. A back surface of each of the receptacle leg portion 152B, the top portion 153B, and the second receptacle lock portion 155 is supported by the second side wall portion 114.

The first receptacle lock portion 154 is configured in such a manner as to be a curved surface protruding from a front surface of the first side wall portion 112. Alternatively, the first receptacle lock portion 154 is configured in such a manner as to include a curved surface protruding from the front surface of the first side wall portion 112. The first receptacle lock portion 154 extends in the transverse direction (Y-axis direction). The cross-sectional shape of the extending portion of the first receptacle lock portion 154 in a direction orthogonal to the transverse direction (Y-axis direction) includes the same curved surface protruding from the front surface of the first side wall portion 112. The second receptacle lock portion 155 is configured in such a manner as to be a curved surface protruding from the front surface of the second side wall portion 114. Alternatively, the second receptacle lock portion 155 is configured in such a manner as to include a curved surface protruding from the front surface of the second side wall portion 114. The second receptacle lock portion 155 extends in the longitudinal direction (X-axis direction). The cross-sectional shape of the extending portion of the second receptacle lock portion 155 in a direction orthogonal to the longitudinal direction (X-axis direction) includes the same curved surface protruding from the front surface of the second side wall portion 114. The first receptacle lock portion 154 and the second receptacle lock portion 155 include receptacle lock side surfaces 159A and 159B exposed from the first side wall portion 112 and the second side wall portion 114, respectively. The receptacle additional member 150 includes receptacle flat portions 156A and 156B located on the first side wall portion 112 side and on the second side wall portion 114 side relative to the positions where the first receptacle lock portion 154 and the second receptacle lock portion 155 are provided, on the bottom side (Z1 side) of the receptacle housing 110 relative to the positions where the first receptacle lock portion 154 and the second receptacle lock portion 155 are provided, respectively.

The receptacle additional member 150 includes a T-shaped portion 158 at a position facing the first receptacle lock portion 154. The T-shaped portion 158 is connected to the first receptacle lock portion 154 via a bottom portion 157 and the receptacle flat portion 156A. The T-shaped portion 158 is held in such a manner that receptacle fixing portions 161 extending in the mating direction (Z-axis direction) cover parts of side walls at an end of the mating protruding portion 116 in the longitudinal direction (X-axis direction). Such a configuration allows fixing the receptacle additional member 150 to the receptacle housing 110. The bottom portion 157, the receptacle flat portion 156A, and the receptacle fixing portion 161 face the receiving portion 118 in a state of being exposed from the receptacle housing 110. Moreover, the receptacle additional member 150 includes a plurality of power supply terminals 160 on a side adjacent to the receptacle terminals 120 (on the X2 side of the receptacle additional member 150 located on the X1 side and on the X1 side of the receptacle additional member 150 located on the X2 side). The power supply terminal 160 is a terminal for supplying a power of approximately several amperes, and is a contact for power supply with the plug connector 200. The power supply terminals 160 of the receptacle additional members 150 are arranged at regular intervals on the second side wall portions 114 in a state of being aligned with the receptacle terminal 120 on both sides (the X1 side and the X2 side) of the receptacle terminal 120.

With reference to FIG. 5 in addition to FIGS. 1 and 2, the receptacle leg portion 152B of the receptacle additional member 150 faces the second receptacle lock portion 155 and the receptacle flat portion 156B across the second side wall portion 114 of the receptacle housing 110. The receptacle leg portion 152B is connected to the second receptacle lock portion 155 and the receptacle flat portion 156B via the top portion 153B located at the upper end of the second side wall portion 114.

The receptacle leg portion 152B is covered with the resin of the receptacle housing 110 (the resin of the peripheral wall portion 113 and the second side wall portion 114) all around except for a portion adjacent to the top portion 153B. In other words, the receptacle leg portion 152B is buried in the second side wall portion 114 by the peripheral wall portion 113 that surrounds the first side wall portion 112 and the second side wall portion 114, except the portion adjacent to the top portion 153B and, accordingly, is held by the receptacle housing 110. The back surface of each of the receptacle leg portion 152B, the top portion 153B, the second receptacle lock portion 155, and the receptacle flat portion 156B (each surface opposite to the surfaces that contact a second plug lock portion 235) is supported by the second side wall portion 114. In other words, the opposing surface of each of the receptacle leg portion 152B on the second receptacle lock portion 155 side and the receptacle flat portion 156B of the receptacle additional member 150 is supported by the second side wall portion 114.

The power supply terminal 160 extends from the receptacle flat portion 156B toward the mating protruding portion 116, and includes a bottom portion 162 connected to the receptacle flat portion 156B and a movable portion 163, between the receptacle flat portion 156B and the movable portion 163. The bottom portion 162 is connected to the receptacle flat portion 156B and the movable portion 163 via a portion that extends in the transverse direction (Y-axis direction) of the receptacle connector 100 and is bent at a right angle. A part of a surface on the board side (a surface opposite to the counterpart terminal receiving surface (the surface on the Z2 side) (a surface on the Z1 side)), that is, a back surface, of the bottom portion 162 is exposed from a back surface of the receptacle housing 110. A portion excluding the exposed portion is supported by the resin near the second side wall portion 114 and the mating protruding portion 116 (refer to FIGS. 5 and 6).

As is clear also from the cross-sectional view illustrated in FIG. 5, the receptacle additional member 150 is formed by insert molding (integral molding) with the receptacle housing 110, and is in intimate contact with the receptacle housing 110 except the portion on the movable portion 163 side of the power supply terminal 160. Moreover, a space surrounded by the receptacle leg portion 152B, the top portion 153B, the second receptacle lock portion 155, and the receptacle flat portion 156B of the receptacle additional member 150 is filled with the resin (the housing).

The movable portion 163 is not in contact with the side wall of the mating protruding portion 116. An end of the movable portion 163 is a free end. The movable portion 163 includes a movable contact 164 that is formed by causing the periphery of the end to protrude toward the second receptacle lock portion 155. The movable portion 163 is pressed by elasticity toward the mating protruding portion 116 and deforms when receiving and mating with a plug additional member 230 being a counterpart additional member. The movable contact 164 comes into contact with a plug leg portion 232 of the plug additional member 230 in the mated state to be electrically connected to the plug leg portion 232.

Next, the configuration of the plug connector 200 is described with reference mainly to FIGS. 6 and 7. The plug connector 200 includes a plug housing 210, the plug terminals 220, and the plug additional members 230 for maintaining a state of being mated with the receptacle connector 100 being the counterpart connector. The plug terminal 220 is made of metal such as phosphor bronze. The plug terminal 220 is buried in the second side wall portion 214 extending in the longitudinal direction (X-axis direction) of the plug housing 210 in a state where a surface that contacts the receptacle terminal 120 being a counterpart terminal is exposed from the second side wall portion 214 and, accordingly, is held by the plug housing 210. The plug terminal 220 includes a mounting portion 221 to be mounted on the board 400 by, for example, soldering in an end thereof.

The plug housing 210 is made of insulating resin such as liquid crystal polymer (LCP). The plug housing 210 includes the first side wall portions 212 extending in the transverse direction (Y-axis direction), and the second side wall portions 214 extending in the longitudinal direction (X-axis direction), and includes the mating recessed portion 216 as a space for housing the mating protruding portion 116, in a center part surrounded by the first side wall portions 212 and the second side wall portions 214.

When the plug connector 200 and the receptacle connector 100 are connected to each other, the mating recessed portion 216 of the plug connector 200 houses the mating protruding portion 116 of the receptacle connector 100. The first side wall portions 212 and the second side wall portions 214 of the plug connector 200 are housed in the receiving portion 118 of the receptacle connector 100.

With reference to FIG. 4 in addition to FIGS. 6 and 7, the plug terminal 220 includes the mounting portion 221 in the end on the board side (Z2 side), and includes the inner leg portion 222 via a portion bent upward (toward Z1) at a right angle from the mounting portion 221. The inner leg portion 222 faces the outer leg portion 225 across the second side wall portion 214 of the plug housing 210. The inner leg portion 222 is connected to the outer leg portion 225 via a top portion 223 located at an end of the second side wall portion 214. A back surface of each of the inner leg portion 222, the top portion 223, a projection portion 224, and the outer leg portion 225 (each surface opposite to the surfaces that contact the counterpart terminal) is supported by the second side wall portion 214.

The projection portion 224 is formed by causing a portion of the outer leg portion 225 adjacent to the top portion 223 to protrude outward. A contact side surface 226 of the projection portion 224 is exposed from the second side wall portion 214. The projection portion 224 can engage with the second receptacle lock portion 155 in a state of being mated with the receptacle terminal 120 being the counterpart terminal and maintain the mated state (locked state). The inner leg portion 222, the top portion 223, the projection portion 224, and the outer leg portion 225 are fixed by the second side wall portion 214 in such a manner as to be immovable upon mating with the counterpart terminal.

As is clear also from the cross-sectional view illustrated in FIG. 4, the plug terminal 220 is formed by insert molding (integral molding) with the plug housing 210, and is in intimate contact with the plug housing 210. Moreover, a space surrounded by the inner leg portion 222, the top portion 223, the projection portion 224, and the outer leg portion 225 of the plug terminal 220 is filled with the resin (the housing).

The plug additional member 230 is placed on each side of the plug connector 200 across a center part of the second side wall portion 214 holding the plug terminal 220. In other words, the plug additional member 230 is provided at each end of the plug connector 200 in the longitudinal direction (X-axis direction). The plug additional member 230 includes two first plug lock portions 234 and a pair of the second plug lock portions 235. The plug housing 210 holds the two first plug lock portions 234 on the first side wall portion 212, and holds the pair of the second plug lock portions 235 on the second side wall portions 214. The plug additional member 230 includes the pair of the second plug lock portions 235 extending in a direction orthogonal to the first plug lock portion 234 (the X-axis direction) respectively on both sides (the Y1 and Y2 sides) of the two first plug lock portions 234 held by the first side wall portion 212. In other words, the two first plug lock portions 234 are located in the transverse direction (Y-axis direction) between the pair of the second plug lock portions 235. A portion including the first plug lock portion 234 and a portion including the second plug lock portion 155 are connected to each other via a plug coupling portion 238. The plug coupling portion 238 is exposed from the plug housing 210.

With reference to FIG. 5, the plug additional member 230 includes a mounting portion 231 to be mounted on the board 400 by, for example, soldering. The plug additional member 230 includes the plug leg portion 232 via a portion bent upward (toward Z1 in the Z-axis direction) from the mounting portion 231. The second plug lock portion 235 and the plug leg portion 232 face each other across the second side wall portion 214. The second plug lock portion 235 and the plug leg portion 232 are connected to each other via a top portion 233B located at an end of the second side wall portion 214.

As is clear also from the cross-sectional view illustrated in FIG. 5, the plug additional member 230 is formed by insert molding (integral molding) with the plug housing 210, and is in intimate contact with the plug housing 210. Moreover, a space surrounded by the plug leg portion 232, the top portion 233B, the second plug lock portion 235, and a plug flat portion 236B of the plug additional member 230 is filled with the resin (the housing).

The plug leg portion 232 is exposed from the second side wall portion 214. A portion between the plug leg portion 232 and the mounting portion 231 is covered with the resin of the plug housing 210. Accordingly, the plug leg portion 232 is held by the plug housing 210. A back surface of each of the first plug lock portion 234 and a top portion 233A is supported by the first side wall portion 212. A back surface of each of the second plug lock portion 235, the top portion 233A, and the plug leg portion 232 is supported by the second side wall portion 214.

Figure 10:
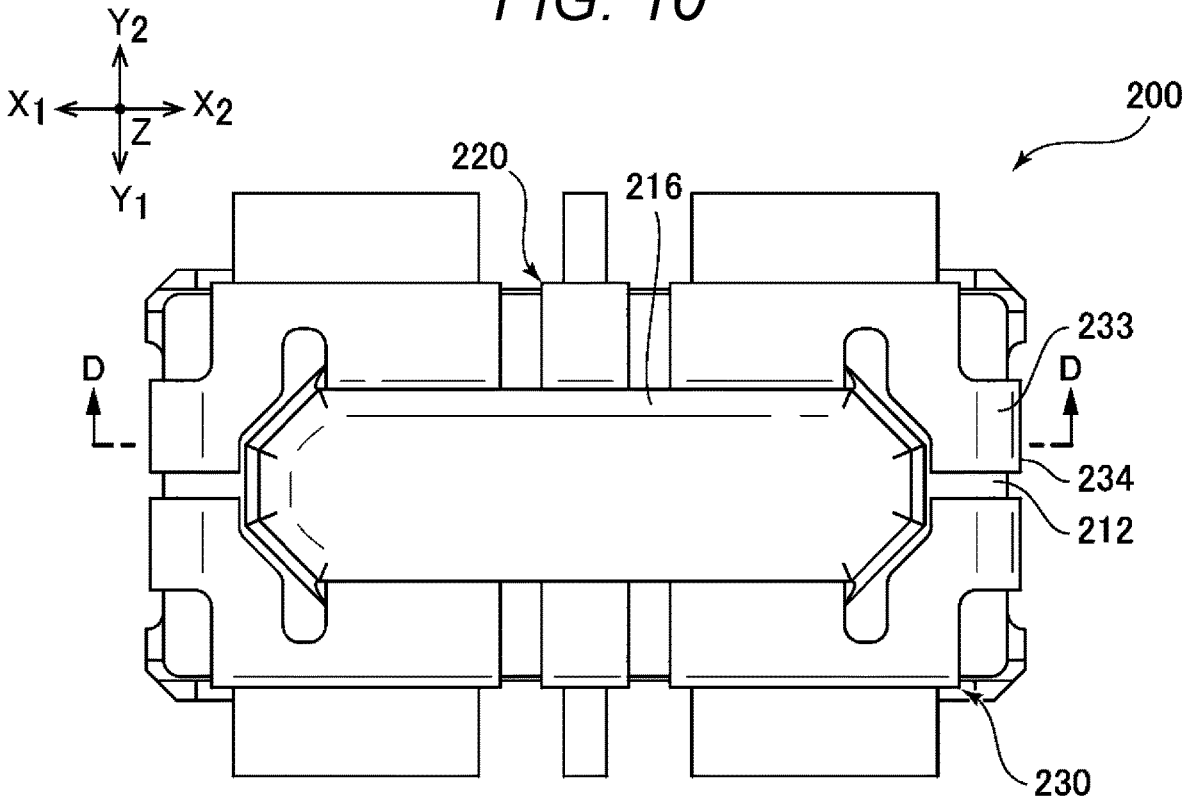
FIG. 10 is a top view of the plug connector according to the embodiment of the present disclosure.
Figure 11:
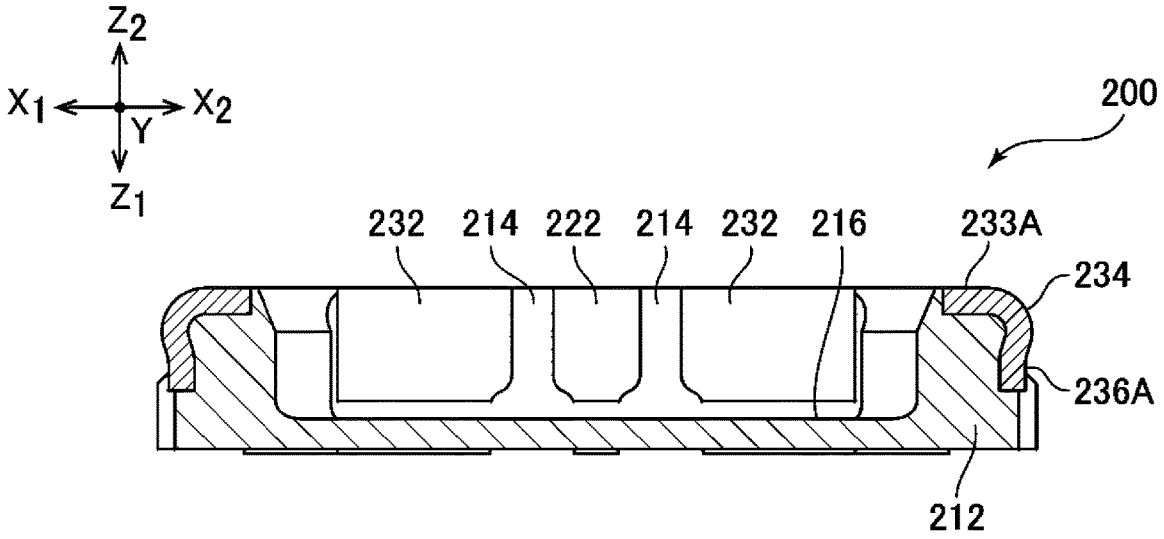
FIG. 11 is a cross-sectional view of the plug connector cut along a cut section D-D illustrated in FIG. 10.

Also with reference to FIGS. 10 and 11 in addition to FIGS. 6 and 7, the configuration of the plug connector according to the embodiment of the present disclosure is described. FIG. 10 is a top view of the plug connector according to the embodiment of the present disclosure. FIG. 11 is a cross-sectional view of the plug connector cut along a cut section D-D illustrated in FIG. 10. The plug leg portions 232 of the plug additional members 230 are placed, evenly spaced from the plug terminal 220, on both sides (the X1 side and the X2 side) of the plug terminal 220, respectively, and held by the second side wall portion 214.

The first plug lock portion 234 is configured in such a manner as to be a curved surface protruding from a front surface of the first side wall portion 212. Alternatively, the first plug lock portion 234 is configured in such a manner as to include a curved surface protruding from the front surface of the first side wall portion 212. The first plug lock portion 234 extends in the transverse direction (Y-axis direction). The cross-sectional shape of the extending portion of the first plug lock portion 234 in a direction orthogonal to the transverse direction (Y-axis direction) includes the same curved surface protruding from the front surface of the first side wall portion 212. The second plug lock portion 235 is configured in such a manner as to be a curved surface protruding from a front surface of the second side wall portion 214. Alternatively, the second plug lock portion 235 is configured in such a manner as to include a curved surface protruding from the front surface of the second side wall portion 214. The second plug lock portion 235 extends in the longitudinal direction (X-axis direction). The cross-sectional shape of the portion, which extends in the longitudinal direction (X-axis direction), of the second plug lock portion 235 in a direction orthogonal to the longitudinal direction (X-axis direction) includes the same curved surface protruding from the front surface of the second side wall portion 214. The first plug lock portion 234 and the second plug lock portion 235 include plug lock side surfaces 237A and 237B exposed from the first side wall portion 212 and the second side wall portion 214, respectively. The plug additional member 230 includes a plug flat portion 236A and the plug flat portion 236B on the bottom side (Z1 side) of the plug housing 210 relative to the positions where the first plug lock portion 234 and the second plug lock portion 235 are provided, respectively.

The first plug lock portion 234 is divided in a direction (X-axis direction) orthogonal to the first side wall portion 212 extending in the transverse direction (Y-axis direction). An end of the divided first plug lock portion 234 and plug flat portion 236A is not provided with a mounting portion to be mounted on the board 400 by, for example, soldering. In other words, the end of the divided first plug lock portion 234 and plug flat portion 236A is a free end. On the other hand, the receptacle flat portions 156A and 156B of the first receptacle lock portion 154 and the second receptacle lock portion 155 of the receptacle additional member 150 are fixed with the mounting portions 151A and 151B to the board 300.

In this manner, the first receptacle lock portion 154 and the second receptacle lock portion 155 are firmly fixed to the board 300. Accordingly, the adjustment of, for example, the amount of interference with the plug additional member 230 with reference to the receptacle additional member 150 allows fine adjustment of the force that is applied when the plug connector 200 and the receptacle connector 100 are connected to each other and while the plug connector 200 and the receptacle connector 100 are being connected to each other (here referred to as a locking force). In other words, it is configured in such a manner that the first plug lock portion 234 divided into two and the plug flat portion 236A are not fixed to the board 400. Accordingly, it is possible to facilitate deformation of the first side wall portion 212 holding the first plug lock portion 234 divided into two, together with the first plug lock portion 234, when the connectors are mated together. Hence, the deformation of the first plug lock portion 234 divided into two and the first side wall portion 212 holding the first plug lock portion 234 allows the force applied to the first plug lock portion 234 to be released and, accordingly, the locking force can be adjusted.

Moreover, the first receptacle lock portion 154 and the second receptacle lock portion 155 of the receptacle additional member 150, and the first plug lock portion 234 and the second plug lock portion 235 of the plug additional member 230 are configured in such a manner as to include the curved surfaces protruding relative to the front surfaces of the first side wall portions 112 and 212 and the front surfaces of the second side wall portions 114 and 214, respectively. Accordingly, it is possible to omit the step of working the metal members (the receptacle additional members 150 and the plug additional members 230) and providing the protruding portion and the recessed portion from the manufacturing process and to reduce the manufacturing cost. Furthermore, the first receptacle lock portion 154 and the second receptacle lock portion 155 of the receptacle additional member 150, and the first plug lock portion 234 and the second plug lock portion 235 of the plug additional member 230 are each configured in such a manner as to include the curved surface supported by the side wall portion. Accordingly, the force that is applied when the connectors are mated and unmated is prevented from concentrating on a single spot. Hence, a structure that is resistant to deformation and wear can be obtained.

The configuration of the plug additional member 230 where the first plug lock portion 234 is divided into two can also be applied to the first receptacle lock portion 154 of the receptacle additional member 150. It can also be configured in such a manner that the first receptacle lock portion 154 of the receptacle additional member 150 is divided into two and an end of the receptacle leg portion 152A connected to the first receptacle lock portion 154 via the top portion 153A is not fixed to the board 300.

Figure 12:
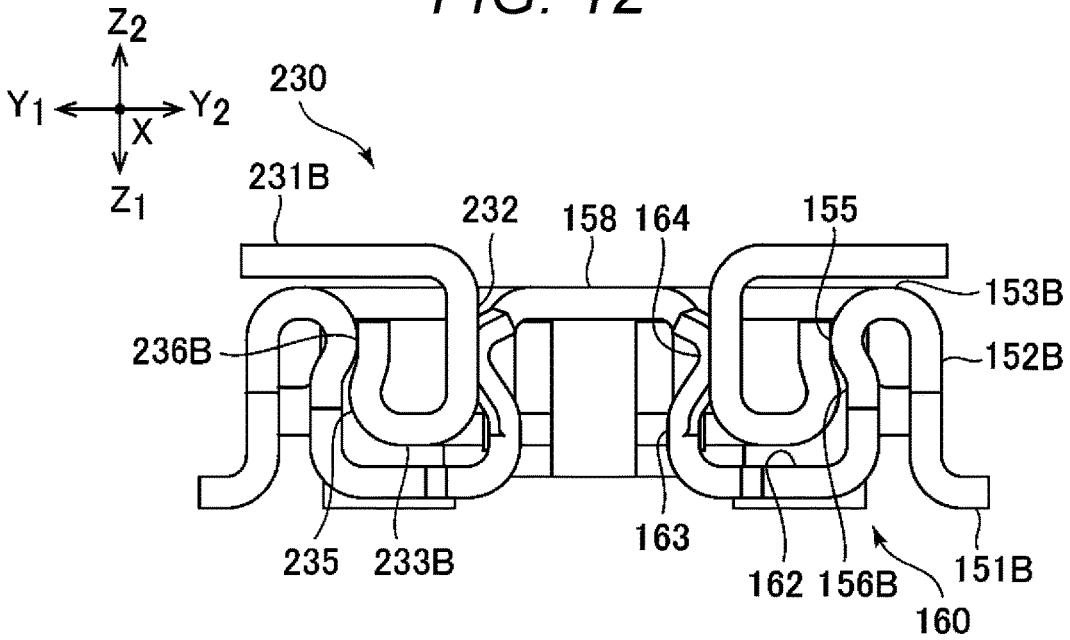
FIG. 12 is a diagram of a state where the plug additional member and the receptacle additional member according to the embodiment of the present disclosure are mated together as viewed from the power supply terminal side.

FIG. 12 is a diagram of a state where the plug additional member and the receptacle additional member are mated together as viewed from the power supply terminal side. The bottom portion 162 extends in the transverse direction (Y-axis direction) from the receptacle flat portion 156B extending downward (toward Z1) of the second receptacle lock portion 155 in the vertical direction. The power supply terminal 160 includes the movable portion 163 being the portion bent upward (toward Z2) from the bottom portion 162 extending in the transverse direction (Y-axis direction). The movable portion 163 is a free end that is not fixed by, for example, the resin of the receptacle housing 110, and includes the movable contact 164 in the end of the movable portion 163. The movable portion 163 is pressed by elasticity toward the mating protruding portion 116 and deforms when receiving the inner leg portion 222 of the plug additional member 230 between the movable portion 163 and the second receptacle lock portion 155. The movable contact 164 comes into contact with a front surface of the inner leg portion 222 of the plug additional member 230 in the state of having received the inner leg portion 222 of the plug additional member 230 between the movable portion 163 and the second receptacle lock portion 155 and, accordingly, is electrically connected to the inner leg portion 222.

Figure 13:
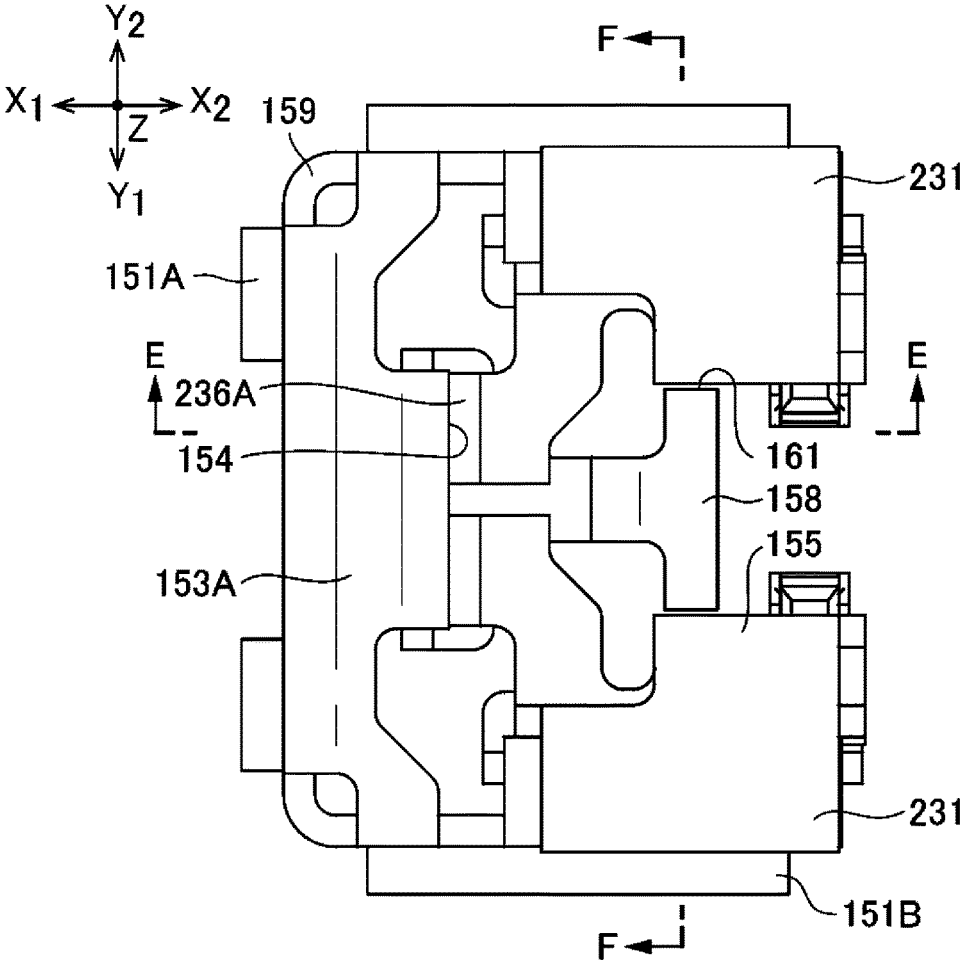
FIG. 13 is a top view of the state where the plug additional member and the receptacle additional member according to the embodiment of the present disclosure are mated together as viewed from the plug connector side.
Figure 14:
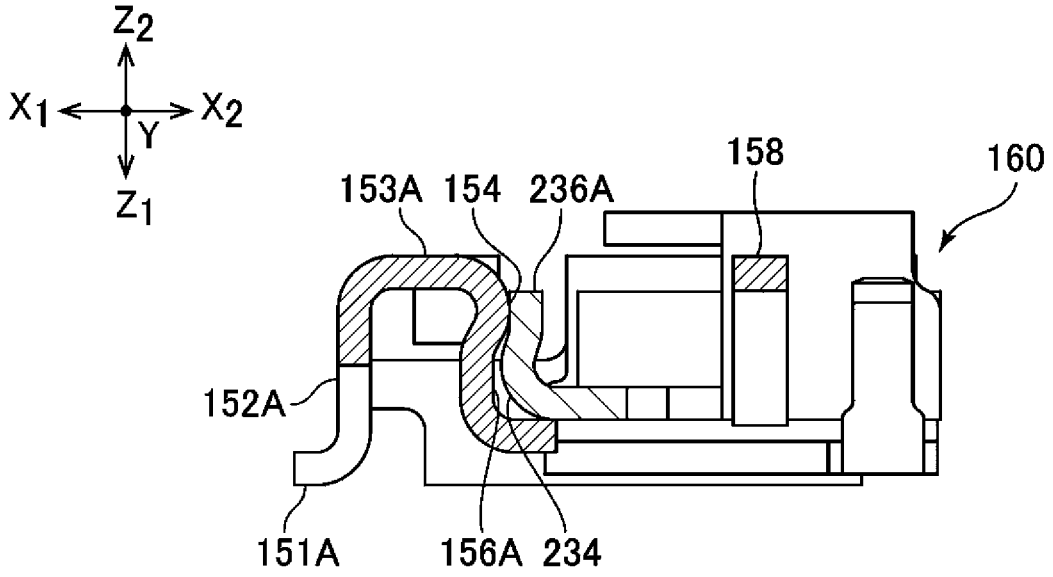
FIG. 14 is a cross-sectional view of the plug additional member and the receptacle additional member, cut along a cut section E-E illustrated in FIG. 13.
Figure 15:
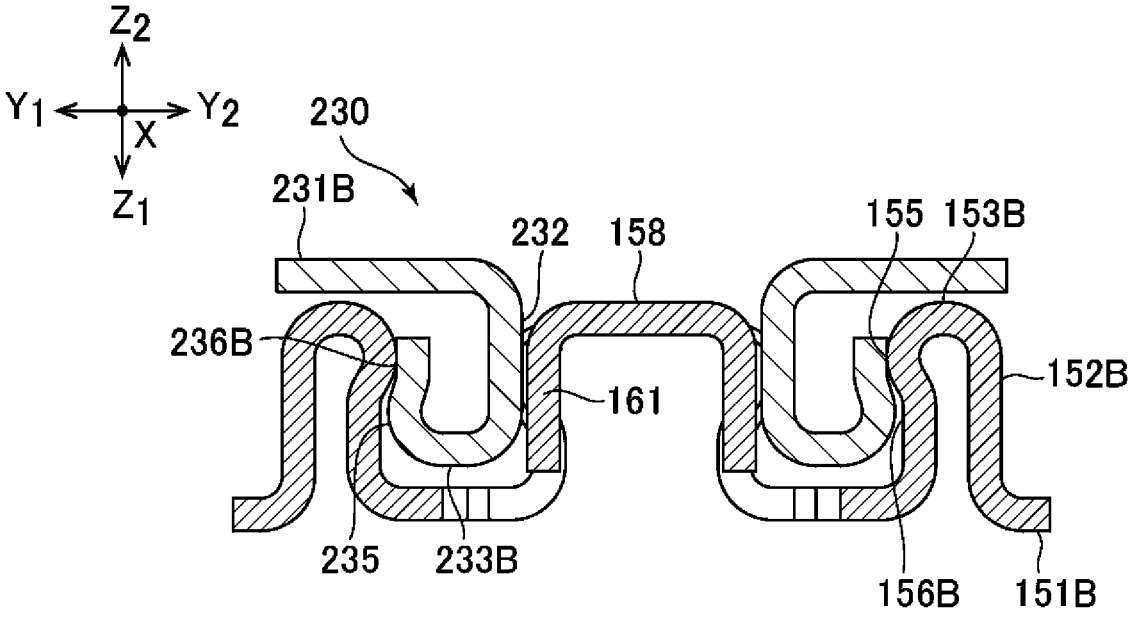
FIG. 15 is a cross-sectional view of the plug additional member and the receptacle additional member, cut along a cut section F-F illustrated in FIG. 13.

FIG. 13 is a top view of the state where the plug additional member and the receptacle additional member are mated together as viewed from the plug connector side. FIG. 14 is a cross-sectional view of the plug additional member and the receptacle additional member, cut along a cut section E-E illustrated in FIG. 13. FIG. 15 is a cross-sectional view of the plug additional member and the receptacle additional member, cut along a cut section F-F illustrated in FIG. 13.

FIG. 14 illustrates the state where the first receptacle lock portion 154 and the first plug lock portion 234 are engaged with each other. It is configured in such a manner that when the receptacle connector 100 and the plug connector 200 being the counterpart connector are connected to each other, the first receptacle lock portion 154 engages with the first plug lock portion 234 being a first counterpart lock portion, and the receptacle flat portion 156A of the first receptacle lock portion 154 receives the first plug lock portion 234. Similarly, it is configured in such a manner that when the plug connector 200 and the receptacle connector 100 being the counterpart connector are connected to each other, the first plug lock portion 234 engages with the first receptacle lock portion 154 being the first counterpart lock portion, and the plug flat portion 236A of the first plug lock portion 234 receives the first receptacle lock portion 154. In this manner, when the first receptacle lock portion 154 engages with the first plug lock portion 234, the receptacle flat portion 156A and the curved surface of the first plug lock portion 234 correspond to and face each other in the longitudinal direction (X-axis direction), and the plug flat portion 236A and the curved surface of the first receptacle lock portion 154 correspond to and face each other in the longitudinal direction (X-axis direction).

Such a configuration allows the first receptacle lock portion 154 and the first plug lock portion 234 to engage with each other. Accordingly, it is possible to maintain the state where the receptacle connector 100 and the plug connector 200 are mated together. As mentioned above, it is configured in such a manner that the first plug lock portion 234 and the plug flat portion 236A are not fixed to the board 300. Accordingly, it is possible to facilitate the deformation of the first side wall portion 212 holding the first plug lock portions 234 together with the first plug lock portions 234 upon mating of the connectors. Hence, the deformation of the first plug lock portions 234 and the first side wall portion 212 allows the force applied to the first plug lock portions 234 to be released and, accordingly, the locking force can be adjusted.

FIG. 15 illustrates the state where the second receptacle lock portion 155 and the second plug lock portion 235 are engaged with each other. It is configured in such a manner that when the receptacle connector 100 and the plug connector 200 being the counterpart connector are connected to each other, the second receptacle lock portion 155 engages with the second plug lock portion 235 being a second counterpart lock portion, and the receptacle flat portion 156B of the second receptacle lock portion 155 receives the second plug lock portion 235. Similarly, it is configured in such a manner that when the plug connector 200 and the receptacle connector 100 being the counterpart connector are connected to each other, the second plug lock portion 235 engages with the second receptacle lock portion 155 being the second counterpart lock portion, and the plug flat portion 236B of the second plug lock portion 235 receives the second receptacle lock portion 155. In this manner, when the second receptacle lock portion 155 and the second plug lock portion 235 engage with each other, the receptacle flat portion 156B and the curved surface of the second plug lock portion 235 correspond to and face each other in the transverse direction (Y-axis direction), and the plug flat portion 236B and the curved surface of the second receptacle lock portion 155 correspond to and face each other in the transverse direction (Y-axis direction).

The second receptacle lock portion 155 and the second plug lock portion 235 engage with each other in such a configuration. Accordingly, it is possible to maintain the state where the receptacle connector 100 and the plug connector 200 are mated with each other. Moreover, the receptacle fixing portion 161 extending downward (toward Z1 in the Z-axis direction) in the mating direction from the T-shaped portion 158 of the receptacle additional member 150 is placed face-to-face with the plug leg portion 232 of the plug additional member 230 when the connectors are mated together.

As described above, the individual embodiments of the present disclosure are not independent, and the present disclosure can be carried out as appropriate by combining the embodiments.

The connector according to the present disclosure can be used for purposes such as connection between boards via a flat cable in an electronic device such as a smartphone or mobile phone that transmits an electrical signal at high speed.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector comprising a plug connector and a receptacle connector, the plug connector comprising:

a plurality of plug terminals;

plug additional members configured to maintain a state of being mated with the receptacle connector; and a plug housing, wherein the plug additional members each include a first plug lock portion extending in a transverse direction and second plug lock portions extending in a longitudinal direction orthogonal to the transverse direction, the plug housing includes first plug side wall portions each holding the first plug lock portion, and second plug side wall portions each holding the second plug lock portions, the first plug lock portion includes a curved surface protruding in the longitudinal direction, the second plug lock portions include a curved surface protruding in the transverse direction, the first plug lock portion is divided into two in a direction orthogonal to the first plug side wall portion, and the second plug lock portions extend in a direction orthogonal to the first plug lock portion, on each side of the first plug lock portion, the receptacle connector comprising:

a plurality of receptacle terminals;

receptacle additional members configured to maintain a state of being mated with the plug connector; and a receptacle housing, wherein the additional receptacle members each include a first receptacle lock portion extending in the transverse direction and second receptacle lock portions extending in the longitudinal direction, the receptacle housing includes first receptacle side wall portions each holding the first receptacle lock portion, and second receptacle side wall portions each holding the second receptacle lock portions, the first receptacle lock portion includes a curved surface protruding in the longitudinal direction, the second receptacle lock portions include a curved surface protruding in the transverse direction, the first receptacle lock portion is divided into two in a direction orthogonal to the first receptacle side wall portion, the second receptacle lock portions extend in a direction orthogonal to the first receptacle lock portion, on each side of the first receptacle lock portion, and the additional receptacle members each further include a t-shaped portion shaped in a t-shape when viewed from a direction orthogonal to the longitudinal direction and the transverse direction, the t-shape portion being connected to the first receptacle lock portion, and wherein when the receptacle connector is mated with the plug connector, the first receptacle lock portion engages with the first plug lock portion and the second receptacle lock portions engage with the second plug lock portions.

2. The connector according to claim 1, wherein the plug additional member includes flat portions on a bottom side of the plug housing relative to positions provided with the first and second plug lock portions, respectively.

3. The connector according to claim 2, wherein it is configured in such a manner that upon connection with the receptacle connector, the first plug lock portion and the second plug lock portion engage with the first and the second receptacle lock portion of the receptacle connector, respectively, the flat portion of the first plug lock portion receives the first receptacle lock portion, and the flat portion of the second plug lock portion receives the second receptacle lock portion.

4. The connector according to claim 3, wherein the plurality of plug terminals is held in a center part of the second plug side wall portion, and the plug additional member is placed on each side of the plug housing across the center part.

5. The connector apparatus according to claim 1, wherein an end of the plug flat portion of the divided first plug lock portion is a free end that is not provided with a mounting portion to be mounted on a board, and an end of the receptacle flat portion of the first receptacle lock portion is provided with a mounting portion to be mounted on a board.

6. The connector apparatus according to claim 1, wherein the receptacle additional member includes a plurality of power supply terminals being contacts for power supply with the plug connector, and the plurality of power supply terminals is arranged on the second side wall portions, aligned with the terminals of the receptacle connector.

7. The connector according to claim 1, wherein the receptacle additional member includes flat portions on a bottom side of the receptacle housing relative to positions provided with the first and second receptacle lock portions, respectively.

8. The connector according to claim 3, wherein the plurality of receptacle terminals is held in a center part of the second receptacle side wall portion, and the additional receptacle member is placed on each side of the receptacle housing across the center part.

* * * * *